US005483761A

United States Patent [19]

Simpson

[11] Patent Number: 5,483,761

[45] Date of Patent: Jan. 16, 1996

[54] DOOR MOUNTED IRONING BOARD ASSEMBLY WITH RETRACTABLE HOLDERS

[75] Inventor: Danny Simpson, Seymour, Ind.

[73] Assignee: Seymour Housewares Corporation, Seymour, Ind.

[21] Appl. No.: 240,310

[22] Filed: May 10, 1994

[51] Int. Cl.[6] ..... D06F 81/06; A47B 5/00

[52] U.S. Cl. ..... 38/137; 248/205.5; 108/48

[58] Field of Search ..... 38/104, 112, 139; 108/42, 44, 48, 108, 117, 134; 248/205.5, 205.7, 205.8, 206.1–206.4, 362, 363

[56] References Cited

U.S. PATENT DOCUMENTS

| | | | |
|---|---|---|---|
| 1,267,270 | 5/1918 | Rheinlander | 248/205.5 X |
| 1,743,694 | 1/1930 | Tierney | 248/205.5 X |
| 2,123,549 | 7/1938 | Williams | 248/363 |
| 2,200,902 | 5/1940 | Solomon | 248/206.3 X |
| 2,402,877 | 6/1946 | Dial . | |
| 2,653,001 | 9/1953 | Padjen | 248/363 X |
| 2,696,389 | 12/1954 | Cessford | 248/206.5 X |
| 3,680,235 | 8/1972 | Leemhius | 38/104 |
| 3,879,005 | 4/1975 | Flick | 248/205.5 |
| 4,657,249 | 4/1987 | Offutt | 248/206.1 X |
| 4,813,641 | 3/1989 | Wilson | 248/206.2 |
| 4,862,611 | 9/1989 | Wright | 38/139 X |
| 5,040,468 | 8/1991 | Miller et al. | 108/134 X |
| 5,110,078 | 5/1992 | Gary | 248/206.2 |
| 5,170,719 | 12/1992 | Pestone | 108/48 |

FOREIGN PATENT DOCUMENTS

| | | | |
|---|---|---|---|
| 0309142 | 3/1989 | European Pat. Off. | 38/104 |
| 2017095 | 10/1992 | WIPO | 108/48 |

*Primary Examiner*—C. D. Crowder
*Assistant Examiner*—Ismael Izaguirre
*Attorney, Agent, or Firm*—King & Schickli

[57] ABSTRACT

An ironing board assembly for mounting on a standard door includes a tubular mounting frame, a pivoted ironing board on the frame and retractable holders on the frame to secure the assembly with respect to the face of the door to resist lateral shifting during ironing and during swinging of the door when the assembly is not in use. The frame is supported by brackets over the top of the door. The holders are mounted on the frame adjacent the bottom and include an integral suction cup and ring. The ring pivots on the tubular frame for retracting to a position substantially within the lateral profile of the frame for protection during handling, such as shipping, but readily positionable through 90° and facing the door during use.

11 Claims, 2 Drawing Sheets

15
10
D
11
2
16
H
2
H
12

11
H
F
20
16
D
3
16
H
20
3
F
16
20
F

DOOR MOUNTED IRONING BOARD ASSEMBLY WITH RETRACTABLE HOLDERS

BACKGROUND OF THE INVENTION

The present invention relates to mounting of an ironing board assembly on a substantially vertical structure, such as a door or the like, and more particularly, to such an assembly with improved holding means to resist shifting during use or upon swinging of the door when not in use.

In recent years, one of the most popular new ironing board units to be introduced into the marketplace is the over-the-door ironing board assembly, as covered in U.S. Pat. No. 5,040,468, issued Aug. 20, 1991 as well as U.S. Pat. Nos. 4,976,205 and 4,899,667, all owned by the assignee of the present invention. One of the key features of this new ironing board concept is the provision for securely holding the ironing board snug against the door to not only resist lateral shifting during ironing, but also to insure stability of the ironing board assembly in the retracted position as the door swings open and closed during periods of non-use. Among the holding means or holders identified and covered in the prior patents are biasing means for the frame, frictional bumpers and/or suction cups. In this regard, reference is made to the '468 patent.

While these holders, separately and in concert together have proven to be successful in helping to make the over-the-board ironing board assembly a success in the marketplace, a couple of significant drawbacks to the design have been identified. In the first instance, the drawback applies to the frictional bumpers, suction cups and/or equivalent holders that may be employed for the desired purpose. For example, it has been found that with the original design, the attachment of bumpers/suction cups requires separate mounting hardware, such as the separate molded plastic support for the suction cup holders (note, for example, FIG. 10 of the '468 patent). This piece, as well as the additional hardware, is a significant cost, especially when considering mass production of these ironing board assemblies.

Also, with this prior art arrangement, it was found that the suction cup, as well as the other components of the holding means, had to be supplied loose during shipping in order to minimize the size (especially the thickness) of the carton. This has proven to be a significant disadvantage in that the parts can be inadvertently omitted from the shipping carton, can be lost or misplaced and most importantly requires the ultimate user to perform an assembly process. While assembling of the suction cup or other holders is not difficult for some people, it can be a trying experience, especially for older users or users that have no mechanical aptitude. Furthermore, with the suction cup having to be left exposed in the ready-to-use position when the ironing board assembly is being moved, it is possible to bend or distort the fragile rim of the cup so that its suction forming ability is adversely affected.

Accordingly, it has been discovered that it is desirable to provide an improvement over the original design, so that the function of the holders for stabilizing the ironing board assembly is enhanced; while at the same time, the cost of the holders for the ironing board assembly can be reduced and can be made easier to use. As an adjunct to these desirable concepts, it is important to provide a design wherein the holders are protected during handling, including during shipping.

SUMMARY OF THE INVENTION

Accordingly, it is a primary object of the present invention to provide an ironing board assembly for mounting to a substantially vertical structure, such as a door or the like, that exhibits improved stability, while at the same time reducing the cost and enhancing the ease of use.

It is another object of the present invention to provide a portable, lightweight ironing board unit that is engineered for a lost cost, easy installation and use, and thus is marketable at a more competitive price that heretofore possible.

It is still another object of the present invention to provide an ironing board assembly fabricated of a simple tubular mounting frame in combination with a unique holding means positioned adjacent the bottom of the frame to insure against lateral shifting during ironing, or during swinging of the door when not in use.

It is still another object of the present invention to provide an ironing board assembly wherein the holders take the form of integral suction cups with built-in retracting means so as to prevent damage during handling, but also to allow easy set-up for use.

Another object of the present invention is to provide an ironing board assembly that can be shipped safely with the holders positioned in a retracted position adjacent the bottom of the frame ready for use.

Still another object of the present invention is to provide an ironing board assembly that includes unique suction cup holder including an integral ring retracting means.

Still another object of the invention, and in accordance with its broader aspects, is to provide a door mounted assembly comprising a utility unit and improved holders having these same advantageous features.

To achieve the foregoing and other objects, an in accordance with the purposes of the present invention, an improved ironing board assembly is provided for mounting on a door other substantially vertical structure. The assembly includes a mounting frame and a suitable ironing board pivotally mounted on the frame for lowering to an operative position and for retracting to a storage position. Suitable brackets are provided across the top of the frame for the door mounting. The improved holding means or holders are included adjacent the bottom to cooperate with the face of the door to resist lateral shifting during ironing, as well as during non-use as the door swings open and closed. In the preferred embodiment, the holders take the form of suction cups. In order to provide portability, the holders are easily releasable from the face of the door.

An important feature of the present invention, as set forth above in some of the contemplated objectives of the invention, is the provision of retracting means as an integral part of the holder to allow easy pivotal movement to a position substantially within the lateral profile or confines of the frame. As a result, not only is the ease of use improved, but also the holding means is protected during shipping and the cost is reduced.

In the preferred embodiment, the frame is tubular and circular in cross section. The retracting means takes the form of a loop, preferably a ring, that extends around the frame to allow the pivotal, retracting movement toward the inside of the frame. Furthermore, the holding means preferably comprises a pair of the suction cup holders positioned on the two sides of the frame. Thus, during use, the suction cup holders are positioned against the face of the door to perform the enhanced holding function; whereas, during handling, the suction cup holders are pivoted 90° into a position bounded by the lateral profile of the assembly. Of particular importance in this respect, when the assembly is being placed in a carton after manufacture, the suction cup holders are protected by the frame so that the thin rim of the suction cup cannot be bent or otherwise mutilated.

Within the broadest aspects of the present invention, an assembly for door mounting or the like comprises a utility unit mounted on a frame with bracket means adjacent the top of the frame for engaging the top edge of the door. As above, holders are provided having sufficient holding properties with the face of the door to resist lateral shifting during use of the utility unit, but easily releasable for portability. The holders are retractable so that they can be moved to an out of the way position within the lateral profile of the frame for handling, but readily positionable for use. Within this broader concept, the frame of the assembly is also tubular and the retracting means comprises a ring extending around the frame adjacent the bottom. Preferably, the holders each comprise a suction cup formed of an elastomeric material and integral with the ring.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other and different embodiments, and its several details are capable of modifications in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in an forming a part of the specification, illustrates several aspects of the present invention, and together with the description serve to explain the principles of the invention. In the drawings.

A description will now be provided in detail of the present preferred embodiment of the invention, an example of which is illustrated in the accompanying drawing.

DETAILED DESCRIPTION OF THE PREFERRED EMBODIMENT

Figures 1, 2, 3:
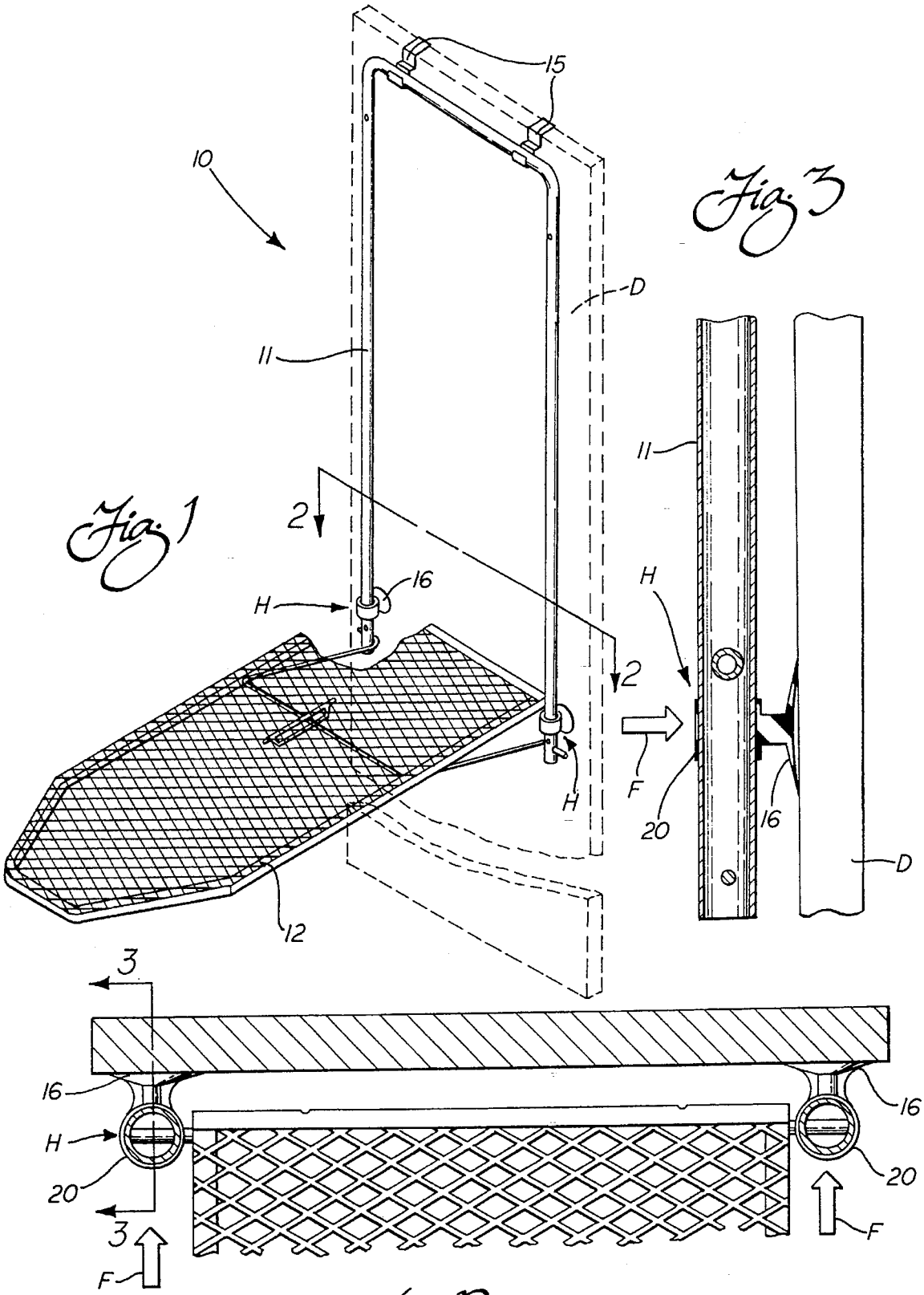
FIG. 1 is a perspective view of the ironing board assembly of the present invention mounted in a representative manner on a door (illustrated in dashed line outline)
FIG. 2 is a cross sectional view taken along line 2—2 of FIG. 1 and showing the manner in which the suction cup holders are firmly attached to the face of the door by manual force.
FIG. 3 is a cross section view taken in the longitudinal direction along one leg of the frame of the ironing board assembly, as depicted by line 3—3 in FIG. 2.

Reference is first made to FIG. 1 showing an ironing board assembly 10 positioned on a door D, as illustrated in dashed line outline. While the ironing board assembly 10 is thus intended for use in this particular environment, it will be realized by those of skill in the art that other environments are contemplated within the broadest aspects of the present invention.

The ironing board assembly 10 includes a mounting frame 11 and an ironing board 12 (shown without a cover) pivotally mounted on the frame 11 for lowering to an operative position and for retracting to a storage position. For a more detailed review of the preferred structural details and the manner of operation, reference is made to the three patents owned by applicant as mentioned above, and particularly to U.S. Pat. No. 5,040,468.

It has been found that a particularly efficient frame for the assembly of the present invention can be fabricated of relatively thin wall, tubular steel or other metal. Preferably, the cross section of the frame is circular. The preferred shape of the frame is an inverted U, as illustrated.

Suitable brackets 15 engage the top of the frame 11 and are positioned over the top of the door D to provide the primary support for supporting the ironing board assembly 11. In accordance with an important aspect of the present invention, a means for holding the ironing board assembly 10 against lateral shifting during use is provided, and in the preferred embodiment, these holding means or holders, generally designated by the reference indicia H, take the form of a pair of suction cups 16.

As will be apparent from also viewing FIGS. 2 and 3 of the drawings, upon installation of the assembly 10 a force F is applied against the frame 11 and each of the holders H opposite the suction cup 16 to firmly engage the face of the door D. As the force F presses the cup against the face, a vacuum is formed between the cup 16 and the door D, thus providing an ideal way of holding the bottom of the frame 11 and resisting lateral shifting during ironing, as well as swinging action of the door when not in use. At the same time, as will be recognized by those of skill in the art, the suction cups 16 can be released by providing a counter force opposite to the force F to break the vacuum so that the entire assembly 10 has the desired portability without marring the face of the door D.

Figure 4:
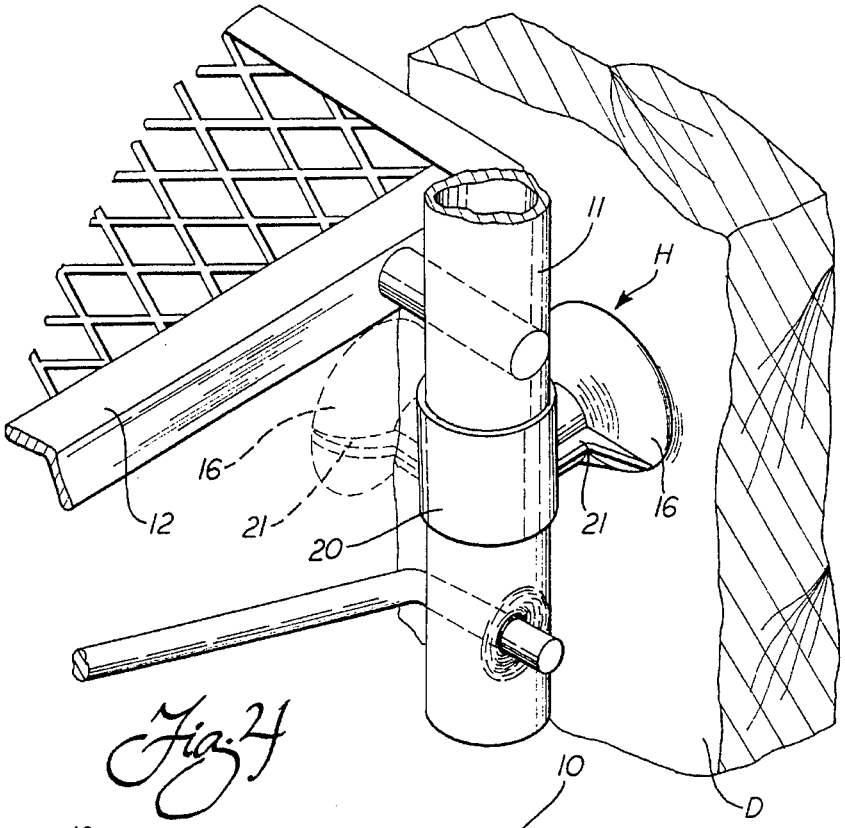
FIG. 4 is an enlarged, partial perspective view of one leg of the frame showing the suction cup holder in a full line operative position during use, and in a 90° pivoted position within the lateral profile of the frame for handling.

As best illustrated in FIG. 4, each suction cup 16 of the holders H that hold the frame 11 against the door D is formed integrally with a loop or ring 20 that serves as a means for retracting the cup 16. Thus, during periods of non-use, such as when the ironing board assembly 10 is being handled, the suction cup 16 can be protected against bending or mutilation. This feature is particularly important during moving from one location to the other, or initially during shipping of the product.

Retraction of the suction cup holder H is specifically illustrated in FIG. 4 by the dotted line position. Specifically, the suction cup 16 is rotated by movement of the holder H through 90° by turning of the ring 20 on the frame 11. As will be readily recognized by those skilled in the art, this positioning along the inside of the frame 11 and substantially within the lateral profile of the entire ironing board assembly 10, provides a unique way of protecting the suction cup 16.

Preferably, to provide for the lowest cost of manufacturing, as well as reliability, the suction cup 16 is formed of elastomeric material, such as rubber, and is integral with the ring 20 to form the holder H. Furthermore, a gusset is formed on each side of the suction cup/ring 16, 20, as designated by the reference numeral 21 in FIG. 4. This gusset serves to strengthen the cup 16, and by being placed on the sides provides for stiffening of the holder H in order to enhance the lateral stability of the entire assembly 10 during use.

In accordance with another feature, the ring 20 is designed to have a snug fit on the tubular frame, which as will be realized is circular in cross section. Thus, the suction cup 16 is frictionally maintained in either the operative or retracted position (see FIG. 4), as positioned by the user of the assembly 10. This in turn provides for a still further advantage in terms of stability, as well as ease of use.

In accordance with a broader aspect of the present invention, the ironing board assembly 10 can be considered to be a utility unit, such as a work table, storage rack or the like. The same advantages are realized by providing the suction cup 16 as a holding means for the assembly in order to resist lateral shifting during use, but being easily releasable for portability. As with the embodiment of the ironing board assembly 10, when utilized as a utility unit the ring 20 serves as an efficient means for allowing retraction of the suction cup 16 to a position substantially within the lateral profile of the frame 11. This provides protection during handling as the utility unit is being moved from one place to the other, or during shipping.

Figure 5:
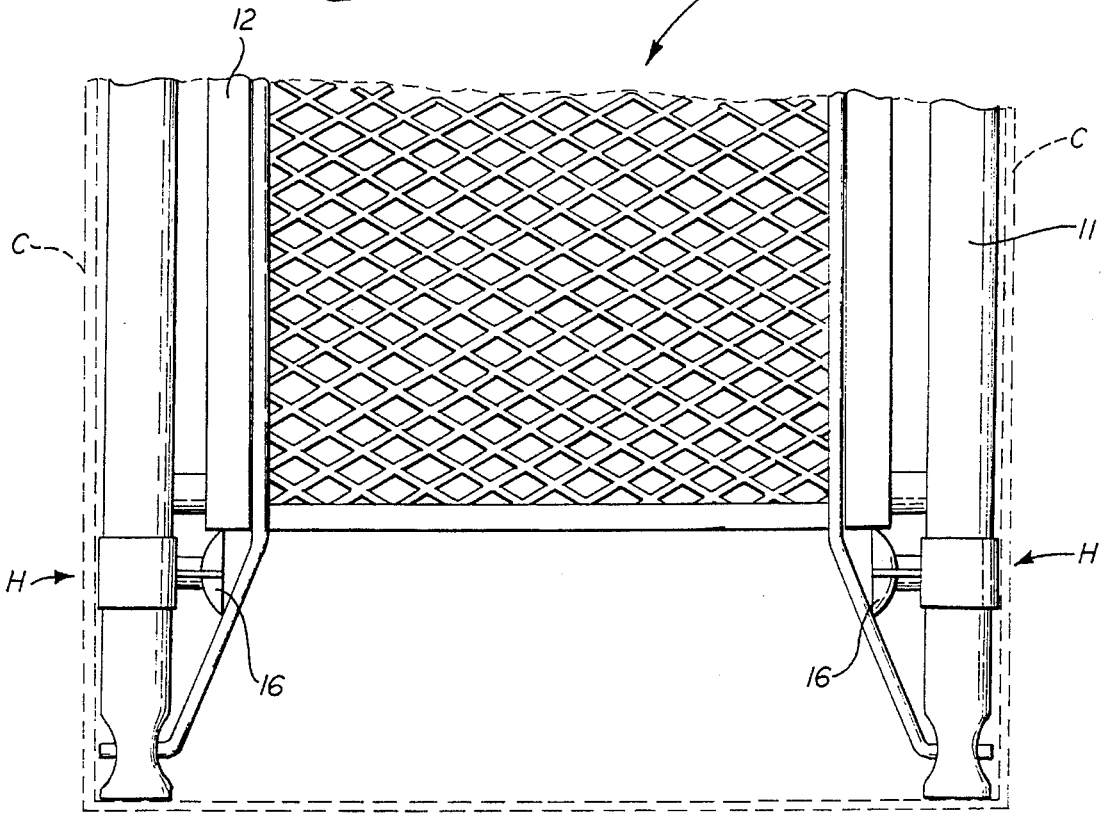
FIG. 5 is a partial plan view of the lower section of the ironing board assembly with the suction cup holders pivoted 90° within the lateral profile of the frame for shipping, and with a typical thin shipping carton illustrated in dashed line outline.

In order to better visualize the protection of the suction cup 16 during shipping, the ironing board assembly 10 is shown in the retracted position in FIG. 5 and inserted into a shipping carton C, shown in dotted line outline. In effect, the carton can be made substantially as thin as the frame 11 with the nested ironing board 12 between the two legs, as illustrated. Because the suction cups 16 are rotated toward the inside of the frame 11 to the protected position, this allows the ironing board assembly 10 to be easily inserted, as well as later removed by the user. In this manner, particularly the thin outer rim of the suction cup 16 is not subject to bending/mutilation, thus assuring reliable holding suction can be provided during each installation of the assembly 10.

In summary, it will be realized that a significant improvement is provided for the ironing board or utility assembly 10 for mounting to a door or other substantially vertical structure. The mounting frame 11 that supports the ironing board assembly 10 has improved lateral stability from use of holders with the suction cups 16 that are formed of elastomeric material and are integral with the ring 20 for pivoting through 90° to a retracted position (see dotted line outline in FIG. 4). The lower cost of fabrication coupled with the improved efficiency for holding the frame 11 in position provides substantial increased economy and performance. The ring 20 is designed to have a snug fit on the tubular frame 11 so that it can be frictionally maintained in the operative or retracted position, as positioned by the user. In the preferred embodiment, one suction cup 16 is provided for holding each depending leg of the U-shaped frame 11.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

I claim:

1. An ironing board assembly for mounting to a substantially vertical structure comprising:

a mounting frame having a top and bottom sides defining a lateral profile;

an ironing board pivotally mounted on the frame for lowering to an operative position and for retracting to a storage position;

bracket means adjacent the top of the frame for engaging a top edge of the substantially vertical structure;

holding means on said ironing board assembly having sufficient holding properties to hold to the face of said substantially vertical structure to resist lateral shifting during ironing, but easily releasable for portability of said ironing board assembly; and means for retracting said holding means to a position substantially within the lateral profile of said frame, whereby said holding means is protected during handling, but readily positionable for use.

2. The ironing board assembly of claim 1, wherein said frame is tubular and said retracting means comprises a loop extending around said frame adjacent the bottom of said ironing board assembly.

3. The ironing board assembly of claim 2, wherein said holding means includes a suction cup.

4. The ironing board assembly of claim 3, wherein said loop comprises a ring including sides, said suction cup being integrally formed of elastomeric material with said ring.

5. The ironing board assembly of claim 4, wherein integrally formed gussets are provided along the sides of said ring and suction cup for stiffening to enhance the lateral stability of said ironing board assembly.

6. The ironing board assembly of claim 2, wherein said tubular frame has a substantially round cross section, said loop being closed to form a ring for positive retention on said tubular frame.

7. The ironing board assembly of claim 2, wherein said tubular frame has a substantially round cross section, said loop being closed to form a ring for positive retention on said tubular frame, said ring being of elastomeric material and having a snug fit on said tubular frame so as to frictionally maintain the operative or retracted position as positioned by the user.

8. The ironing board assembly of claim 1, wherein said frame is an inverted, tubular U-shaped frame with depending spaced legs, said holding means being provided on each of said legs adjacent the bottom, said retracting means being effective to position said holding means inwardly with respect to said frame.

9. An assembly for mounting to a substantially vertical structure, comprises:

a mounting frame having a top and bottom and sides defining a lateral profile;

a utility unit mounted on the frame;

bracket means adjacent the top of the frame for engaging a top edge of the substantially vertical structure, holding means on said assembly having sufficient holding properties to hold to the face of said substantially vertical structure to resist lateral shifting during use of said utility unit, but easily releasable for portability of said utility unit; and means for retracting said holding means to a position substantially within the lateral profile of said frame, whereby said holding means is protected during handling, but readily positionable for use.

10. The assembly of claim 9, wherein said frame is tubular and said retracting means comprises a ring integral with said holding means extending around said frame adjacent the bottom.

11. The assembly of claim 10 wherein said holding means includes a suction cup formed of an elastomeric material and integral with said ring.

* * * * *